United States Patent [19]

Sasuga

[11] 4,190,246

[45] Feb. 26, 1980

[54] PAPER FEEDING SYSTEM

[75] Inventor: Kazuyasu Sasuga, Ebina, Japan

[73] Assignee: Rank Xerox Limited, London, England

[21] Appl. No.: 870,301

[22] Filed: Jan. 17, 1978

[30] Foreign Application Priority Data

Jan. 27, 1977 [JP] Japan ..... 52/7913[U]

[51] Int. Cl.[2] ..... B65H 1/00

[52] U.S. Cl. ..... 271/145; 271/9; 271/265

[58] Field of Search ..... 271/145, 261, 265, 171, 271/9

[56] References Cited

U.S. PATENT DOCUMENTS

| | | | |
|---|---|---|---|
| 3,622,238 | 11/1971 | Alman | 271/9 X |
| 3,977,666 | 8/1976 | Suzuki | 271/171 X |

OTHER PUBLICATIONS

J. L. Bacon, Copy Sheet Size Selection, IBM Technical Disclosure Bulletin, vol. 17, No. 9, Feb. 1975, pp. 2690–2690A.

*Primary Examiner*—Richard A. Schacher
*Attorney, Agent, or Firm*—William A. Henry, II

[57] ABSTRACT

A selector circuit for use with a paper tray in a copy machine to determine the sizes of paper stored in the paper trays, compare the available sizes with the operator-selected size and enable the proper paper tray feed mechanisms to assure feeding the desired size paper.

1 Claim, 4 Drawing Figures

PAPER FEEDING SYSTEM

BACKGROUND OF THE INVENTION

The present invention relates to a selector circuit in a paper feeder for use in a copying machine or the like.

Among the copying machines known theretofore, a number are equipped with a plurality of paper feed trays. Such a machine holds upper and lower trays each capable of storing paper of various sizes. The conventional copying machine of this type may have a control panel where paper-size indicating windows are formed together with the provision of an upper-tray selector switch and a lower-tray selector switch. An operator presses either the selector switches after determining by visual inspection which of the upper and lower trays stores the paper of a desired size.

In this case, it is necessary for the operator to distinguish first the tray that stores the paper of the desired size and then to press the corresponding selector switch according to the result of distinction. Since the desired-size paper may be in the upper tray or the lower tray, the selection operation may be confusing and is liable to be performed erroneously.

In an attempt to eliminate the above described disadvantages, the present invention has been accomplished to achieve improvements by allowing an operator to select a desired paper size directly, the control automatically registering and encoding a signal representative of the selected size, comparing the signal thus encoded with encoded signals representative of the paper sizes in the trays, and checking electrically and automatically whether any of the paper stored in the trays coincides with the desired size, and starting to feed the paper of the coincident size automatically from the corresponding trays or, in case the paper of the coincident size is not present in the tray, indicating such state.

In the above procedure, the operator's work requirement is merely to press a selector switch for the paper of a desired size. In this manner the operation is facilitated and the panel structure is simplified since it requires no more than paper-size selector switches and a "No-Paper" indicator.

DESCRIPTION OF THE PREFERRED EMBODIMENT

Hereinafter the present invention will be described in detail with reference to the accompanying drawings.

Figure 1:
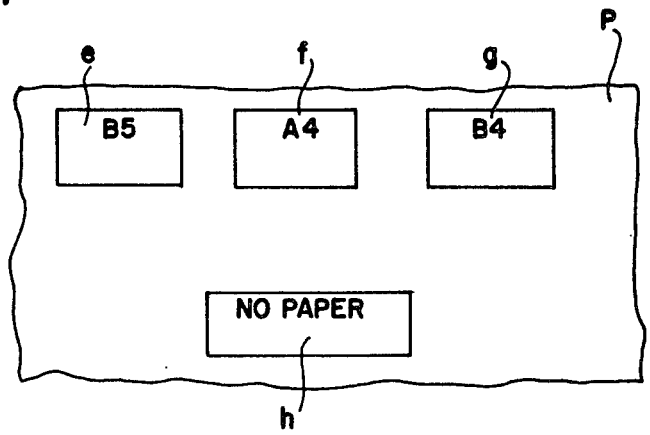
FIG. 1 illustrates an example of a control panel in the present invention.
Figure 2:
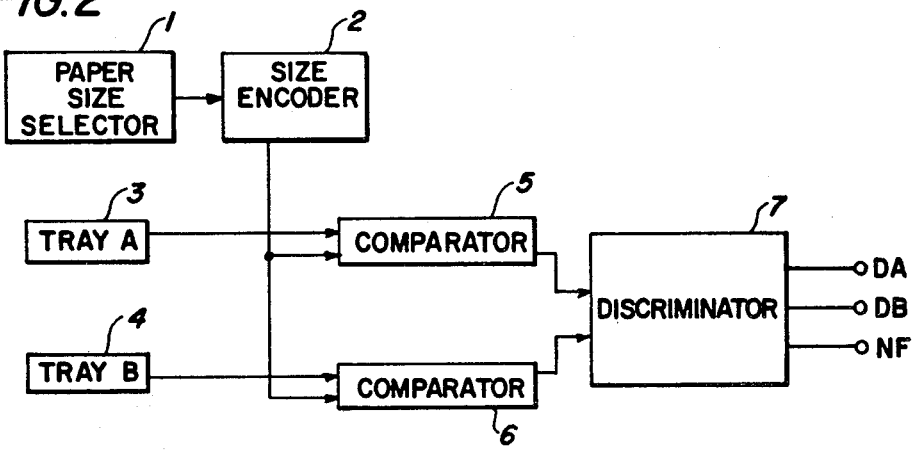
FIG. 2 is a block diagram of the present invention.

Referring particularly to FIG. 2, (1) is a circuit for selecting a desired paper size such as A4, B4 or B5; (2) is a circuit for encoding the selected paper size; (3) and (4) are size encoding circuits for detecting the presence or absence of the paper actually stored in a tray A and a tray B, and encoding the paper sizes individually; (5) and (6) are circuits for comparing the code of the selected paper size with the codes representing the sizes of the paper stored actually in the trays; (7) is a discriminator circuit for generating, in accordance with the result of comparison, a signal DA or a signal DB to feed the paper from either the tray A or the tray B, or generating a signal NP to indicate the absence of the paper of the corresponding size.

Figure 3:
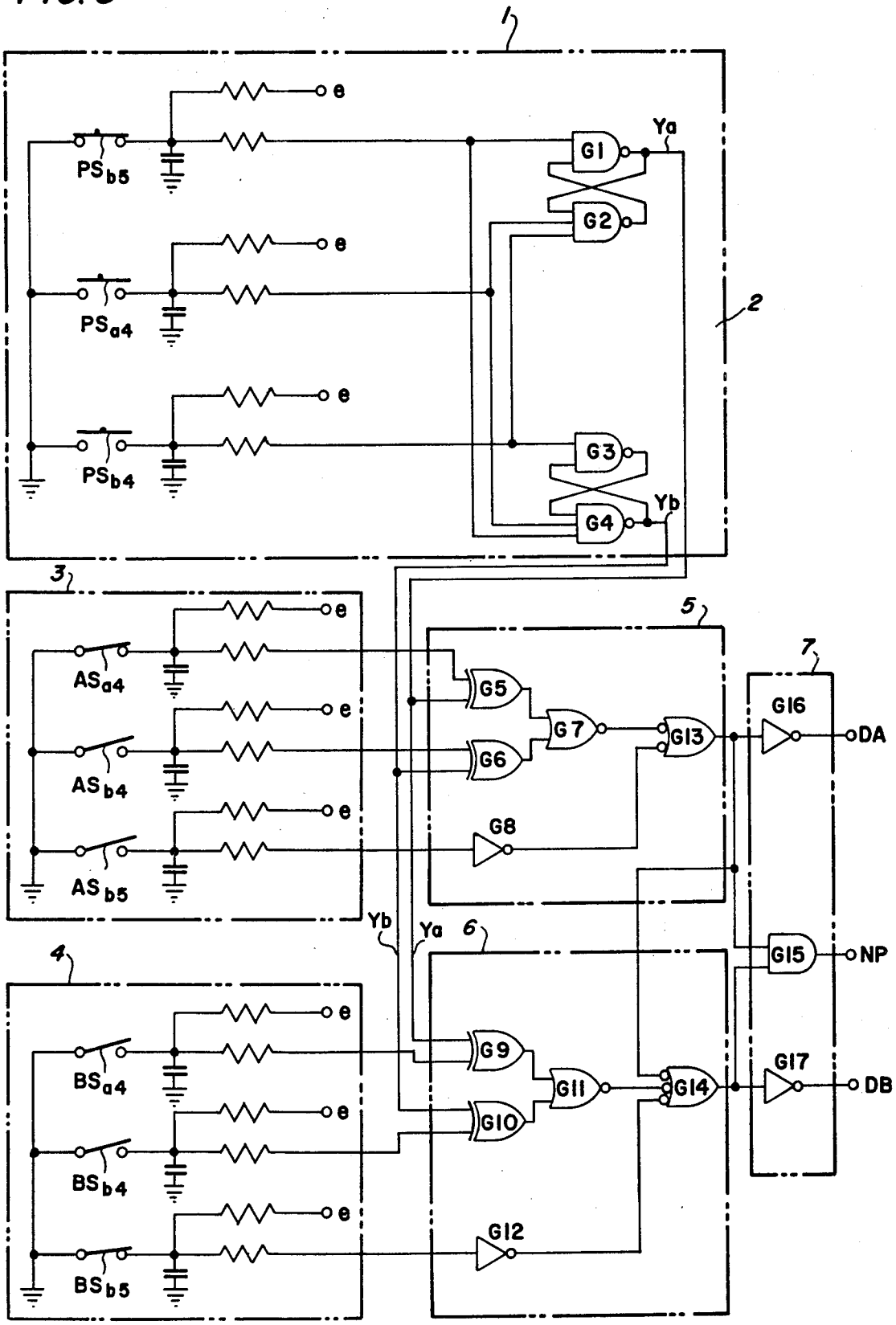
FIG. 3 is a block diagram showing the concrete composition of an embodiment of the invention.

FIG. 3 shows an exemplary concrete circuit implementing the present invention, in which: PS is a selector switch of the paper-size selector circuit (1), and each of symbols b5, a4 and b4 added thereto denotes the individual paper size; G1 through G4 are gates of the encoder circuit (2); AS and BS are paper-size detector switches of the A-tray and B-tray paper-size encoder circuit (3); G5 through G14 are gates constituting the comparator circuits (5) and (6); G15 though G17 are gates constituting the discriminator circuit (7); DA and DB are signals for selecting the trays A and B respectively; and NP is a No-Paper signal indicating that the paper of the selected size is not stored in any of the trays.

Figure 4:
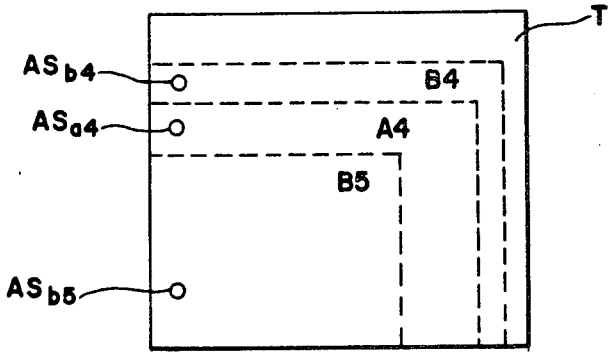
FIG. 4 plots an exemplary arrangement of switches on a tray adapted for paper-size encoder circuits implementing the invention.

Supposing now that the paper-size detector switches AS and BS are installed on the tray T as illustrated in FIG. 4, then the paper size encoding is performed as tabulated in the column "Switches AS and BS" of Table 1. It will be understood from FIG. 3 that the selected paper size is encoded in the manner given in the column "Selected Size" of Table 2. The on-off positions of the switches plotted in FIG. 3 show the state where size B5 is selected by an operator and A4-size paper is stored in the tray A while B5-size paper is stored in the tray B respectively. In this instance, since both Ya and Yb become "1", the output of G5 (hereinafter referred to simply as G5 for brevity; the same with respect to other gates) becomes "1" as given in Table 2 and subsequently it is followed by G6→"0", G7→"0", G8→"1", G13→"1" and G16→"0" so that the A-tray feed signal DA is not sent out. Meanwhile, G9 becomes "0" and it is followed by G10→"0", G11→"1", G12→"1", G14→"0" and G17→"1" so that the B-tray feed signal DB is sent out. At this time, since G15 is "0", the no-paper indicating signal NP is not generated. The action of the circuits of FIG. 3 for some combinations of paper sizes in the trays is performed in the manner given in Table 2, and: (i) when paper of a desired size is stored in both the trays A and B, the paper is fed from the tray A by priority; and (ii) when paper of a desired size is not stored in any of the trays, or when no paper is stored at all, then a signal NP is generated to indicate necessity of paper supply.

According to the present invention, as described hereinabove, the operator's action to be taken is merely to select and specify a desired paper size. Consequently, remarkable advantages are achievable including elimination of the possibility of erroneous operation and also simplification of the panel structure.

Table 1

| | Switches AS & BS | | | Selected size | |
|---|---|---|---|---|---|
| Paper size | a4 | b4 | b5 | Ya | Yb |
| A4 | 0 | 1 | 0 | 0 | 1 |
| B4 | 0 | 0 | 0 | 0 | 0 |
| B5 | 1 | 1 | 0 | 1 | 1 |

Table 2

| Stored paper sizes | Tray A<br>Tray B | A4<br>B5 | B5<br>B4 | B5<br>B5 | A4<br>B4 | None<br>None |
|---|---|---|---|---|---|---|
| Ya | | 1 | 1 | 1 | 1 | 1 |
| Yb | | 1 | 1 | 1 | 1 | 1 |
| G5 | | 1 | 0 | 0 | 1 | 0 |

Table 2-continued

| Stored paper sizes | Tray A<br>Tray B | A4<br>B5 | B5<br>B4 | B5<br>B5 | A4<br>B4 | None<br>None |
|---|---|---|---|---|---|---|
| G6 | | 1 | 0 | 0 | 0 | 0 |
| G7 | | 0 | 1 | 1 | 0 | 1 |
| G8 | | 1 | 1 | 1 | 1 | 0 |
| G13 | | 1 | 0 | 0 | 1 | 1 |
| G16 | | 0 | 1 (Signal DA) | 1 (Signal DA) | 0 | 0 |
| G9 | | 0 | 1 | 0 | 1 | 0 |
| G10 | | 0 | 1 | 0 | 1 | 0 |
| G11 | | 1 | 0 | 1 | 0 | 1 |
| G12 | | 1 | 1 | 1 | 1 | 0 |
| G14 | | 0 | 1 | 1 | 1 | 1 |
| G17 | | 1 (Signal DB) | 0 | 0 | 0 | 0 |
| G15 | | 0 | 0 | 0 | 1 (Signal NP) | 1 (Signal NP) |

While I have described the preferred embodiment of this invention is should be understood that the invention is not limited thereto but may be otherwise embodied within the scope of the following claims.

What is claimed is:

1. In a paper feeder for use in a copying machine equipped with a plurality of trays for storing paper of various sizes; the improvement comprising:

a circuit for encoding a selected paper size from a number of available paper sizes;

circuit means for detecting and encoding the sizes of paper stored in the plurality of trays;

a comparator circuit for comparing said selected paper size with one of the plurality of trays that contains paper corresponding to the selected paper size; and a dual discriminator circuit for generating signals in response to the output of said comparator circuit, said discriminator circuit in a first mode enables paper feeding from a selected tray if paper is available for feeding and in a second mode generates a signal to indicate necessity of adding paper to the selected tray if the tray is empty.

* * * * *